United States Patent [19]

Rose et al.

[11] Patent Number: 4,751,763

[45] Date of Patent: Jun. 21, 1988

[54] MOP BUCKET INSERT

[75] Inventors: Edward S. Rose, Leawood, Kans.; Stan Boyd, Kansas City, Mo.

[73] Assignee: E and R Investments, Kansas City, Kans.

[21] Appl. No.: 886,321

[22] Filed: Jul. 17, 1986

[51] Int. Cl.[4] ..... A47L 13/58

[52] U.S. Cl. ..... 15/264; 15/257 R; 206/361

[58] Field of Search ..... 15/260–264, 15/257.05, 257 R; 206/361

[56] References Cited

U.S. PATENT DOCUMENTS

| | | | |
|---|---|---|---|
| Re. 17,754 | 7/1930 | Schulman | 15/263 |
| 1,748,756 | 2/1930 | Cutler | 15/263 |
| 1,886,184 | 11/1932 | Heber | 15/263 |
| 3,555,589 | 1/1971 | Quimby | 15/260 |

FOREIGN PATENT DOCUMENTS

| | | | |
|---|---|---|---|
| 2036622 | 3/1979 | Fed. Rep. of Germany | 15/260 |

*Primary Examiner*—Edward L. Roberts

*Attorney, Agent, or Firm*—Kokjer, Kircher, Bradley, Wharton, Bowman & Johnson

[57] ABSTRACT

A mop bucket insert for maintaining a portion of a cleaning liquid contained in a bucket free of suspended solids. A platform spaced above the bottom of the bucket and side walls coupled with the platform substantially segregated solids which have settled in the compartment formed between the bucket bottom and platform, preventing suspension of these solids when a mop agitates the liquid. The platform provides a surface against which a cleaning instrument may be applied to remove solids entrained in the fibrous elements of the mop.

13 Claims, 2 Drawing Sheets

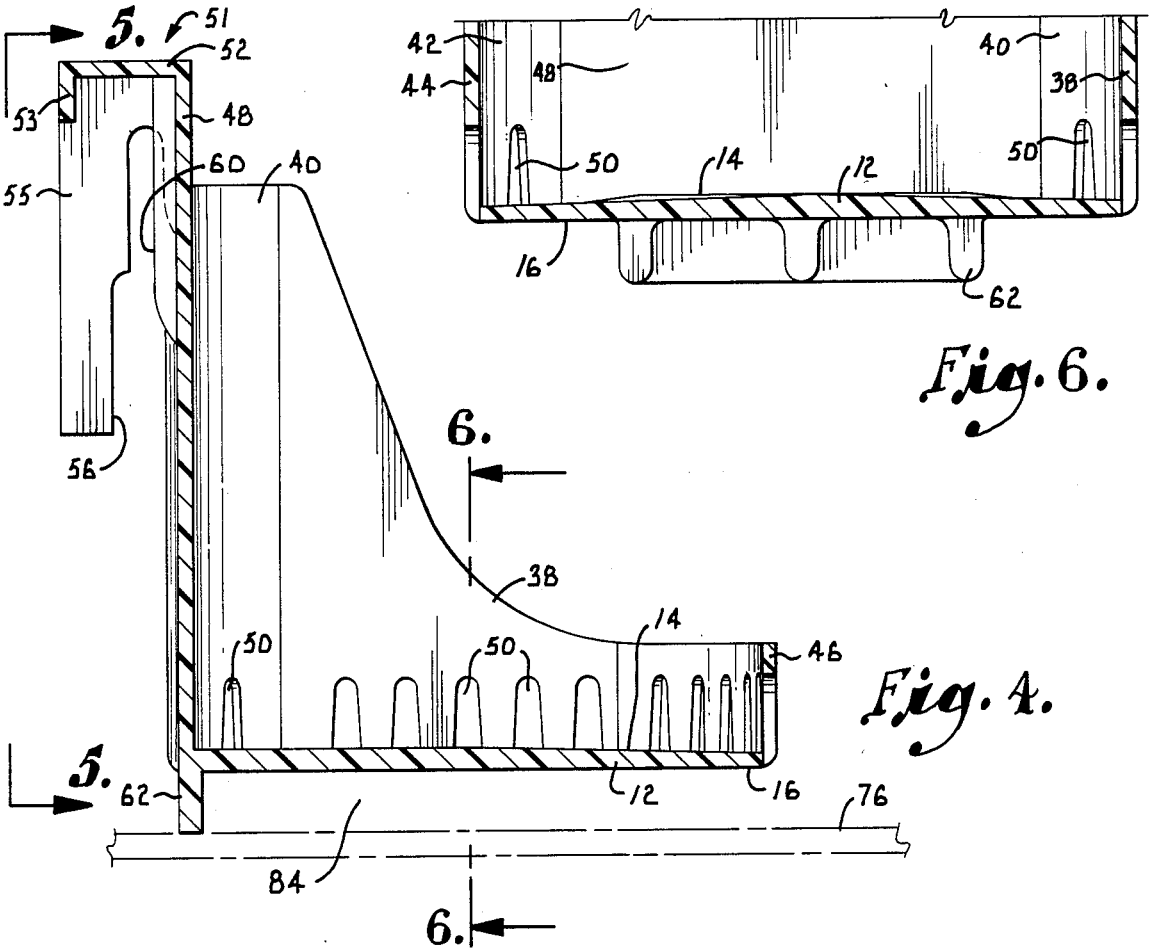
Fig. 4.
Fig. 6.
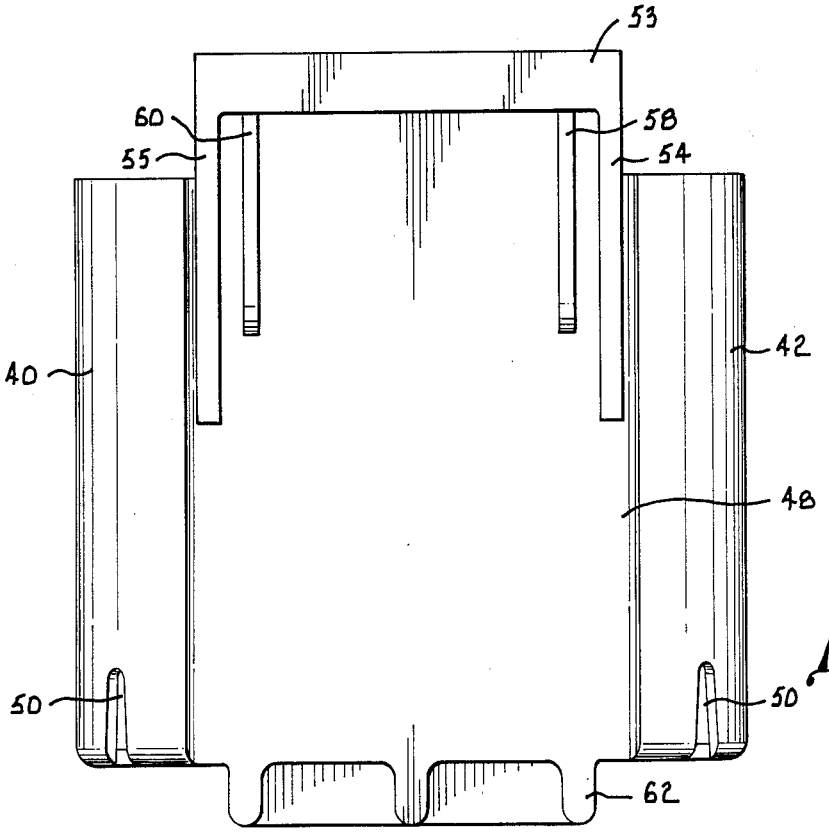
Fig. 5.

MOP BUCKET INSERT

BACKGROUND OF THE INVENTION

This invention is directed to cleaning equipment and, more particularly, to an insert for a bucket for containing a cleaning liquid.

Containers such as mop buckets for holding a cleaning fluid are well known in the prior art. These containers are used for cleaning purposes by placing a quantity of a fluid, such as water in combination with a detergent which includes a surfactant, in the bucket. A cleaning instrument such as a mop or sponge is wetted by placement in the liquid. The instrument is then withdrawn from the liquid and excess liquid is removed by squeezing with the hand or using a wringer coupled with either the container of the instrument. The instrument is then applied to the surface to be cleaned and dirt on the surface is loosened and picked up by the instrument. The dirt is then transferred to the cleaning liquid when the instrument is replaced in the container and agitated to remove the entrained dirt.

This method of cleaning is disadvantageous in that a portion of the solids which are suspended in the cleaning liquid in the container are picked up by the cleaning instrument and transferred to the surface to be cleaned. Although most of the suspended solids will settle to the bottom of the container after a period of time, agitation of the instrument in the liquid creates a turbulent or mixing force which causes the precipitated solids to mix with the liquid. As cleaning continues using the same solution, dirt is redeposited onto the surface being cleaned whenever the instrument is dipped back into the solution. The cleaning liquid should eventually be discarded and renewed when the concentration of suspended solids becomes excessive, although this is seldom done on a timely basis. This cleaning method thus results in inefficient use of labor and materials.

Even if the cleaning instrument is carefully placed in the liquid so that the mixing is held to a mimimum, unsatisfactory cleaning results may still be obtained since the instrument must normally be agitated to sucessfully remove the entrained dirt and solids so they are not transferred to the surface in need of cleaning. In addition, the fibrous elements of cleaning instruments such as mops often come into contact with the settled solids, causing the solids to mix with the liquid and decreasing the cleaning efficiency of the liquid.

SUMMARY OF THE INVENTION

Therefore, it is an objective of this invention to provide an insert to use in a container for holding a cleaning solution to segregate precipitated solids from a portion of the cleaning solution.

Another objective of this invention is to provide a platform in the cleaning liquid against which the cleaning instrument may be placed to aid in transfer of dirt from the instrument to the cleaning liquid while sheltering the precipitated solids from the mixing force created.

It is a further objective of this invention to provide a cleaning method which makes more efficient use of a cleaning liquid over an extended period of time during cleaning operations.

To achieve these and other objectives, a platform is coupled with the container and located above the bottom of the container to create a region which is substantially segregated from the mixing force imparted to the liquid by the cleaning instrument. The solids settle into the region as they precipitate and the platform minimizes the mixing of the precipitated solids with the liquid. This enables the major part of the liquid to remain relatively clean and allows the cleaning solution to be used for an extended period of time. Better cleaning results are also obtained since fewer solids are picked up by the cleaning instrument and transferred to the surface to be cleaned. The platform also provides a rigid surface against which the cleaning instrument may be agitated for more complete removal of the dirt entrained in the fibrous elements of the instrument.

BRIEF DESCRIPTION OF THE DRAWINGS

In the accompanying drawings which form a part of the specification and are to be read in conjunction therewith and in which like reference numerals are used to indicate like parts in the various views:

FIG. 4 is a section view taken generally along lines 4—4 of FIG. 3 in the direction of the arrows, with a fragment of the bottom of the bucket shown in phantom lines;

FIG. 5 is an elevation view taken generally along section lines 5—5 of FIG. 4 in the direction of the arrows; and FIG. 6 is a fragmentary sectional view taken generally along lines 6—6 of FIG. 4 in the direction of the arrows.

DESCRIPTION OF THE PREFERRED EMBODIMENT

Figure 1:
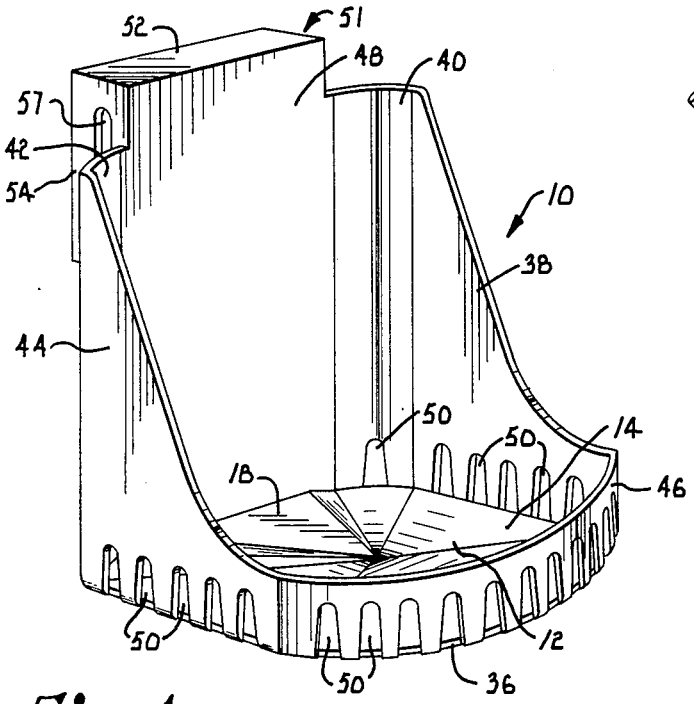
FIG. 1 is a perspective view of a bucket insert constructed according to a preferred embodiment of the present invention.
Figure 2:
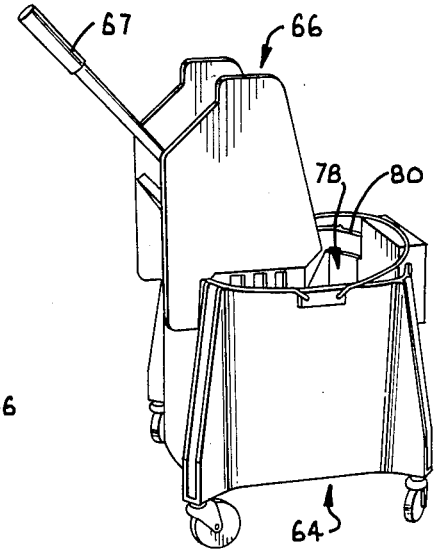
FIG. 2 is a perspective view of the insert positioned in a conventional mop bucket with a wringer.
Figure 3:
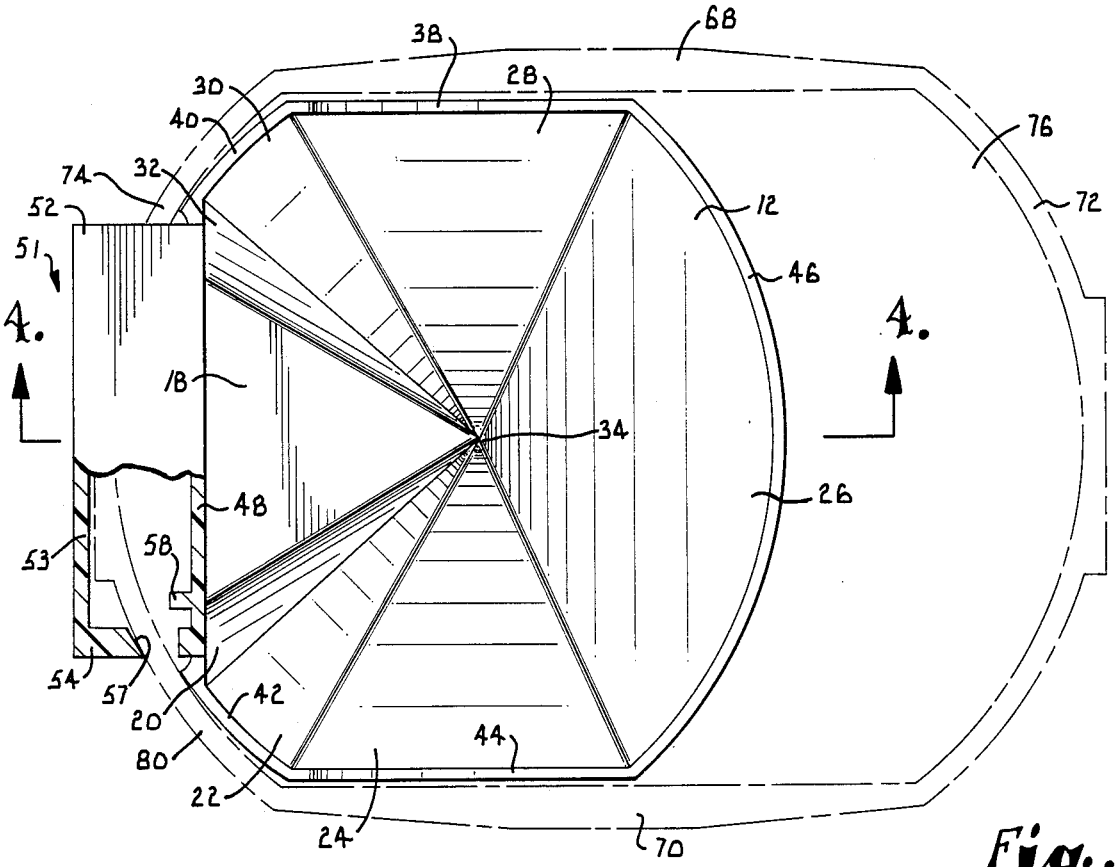
FIG. 3 is an enlarged top plan view of the insert positioned in a bucket illustrated by phantom lines, with a portion of the insert broken away from illustration purposes.

Referring now to the drawings, the bucket insert of the present invention is designated generally by the numeral 10. The insert 10 comprises an imperforate platform 12 with a top surface 14 and a bottom surface 16. The plane of the bottom surface 16 is substantially horizontal while the top surface 14 is divided into substantially flat triangular or pie-shaped sections 18, 20, 22, 24, 26, 28, 30 and 32. Section 18 is oriented in a substantially horizontal plane and the other sections 20, 22, 24, 26, 28, 30, and 32 slope downwardly from a central point 34 to a peripheral edge 36 of the top surface 14. In addition, regions 20 and 32 are inclined downwardly toward regions 22 and 30, respectively.

Insert 10 also includes along the peripheral edge 36, upwardly projecting side walls 38, 40, 42 and 44, and front and back walls 46 and 48, respectively. The walls 40, 42 and 48 are of a height to extend from the platform 12 to near the upper rim of a bucket when the insert 10 is placed within the bucket. Wall 36 is preferably of a substantially lesser height, and the height of walls 38 and 44 decrease in a downwardly curving fashion from walls 40 and 42 respectively to wall 36. Walls 38, 40, 42, 44 and 46 include a number of arching cutaway segments or perforations 50 which extend upwardly from the bottom surface 16. Front wall 46 is preferrably outwardly bowed to follow the leading curved edge of bottom surface 16.

The back wall 48 preferably has a hook-like bracket 51 for mounting the insert 10 on a side wall of a bucket, but other suitable means may be employed to position the insert in relation to the bucket. The bracket 51 includes a horizontal plate 52 with a downwardly projecting flange 53 extending between a pair of arms 54 and 55 which project downwardly from opposite sides of plate 52. The arm 55 is spaced from the back wall 48 to form a notch 56 (FIG. 4) for sliding over the rim of the bucket. The notch 56 is of smaller width at its closed end than at its open end. Arm 54 is spaced from the end wall 48 in an identical manner and creates a similarly configured notch 57 (see FIG.s 1 and 3). Ribs 58 and 60 are included on wall 48 to aid in stabilizing the insert 10 on the wall of the bucket. A foot portion 62 projects downwardly from the bottom surface 16 of the platform 12 below the wall 48 and engages the bottom of the bucket to further stabilize the apparatus 10. The configuration of the notches 56 and 57 in combination with the foot 62 and ribs 58 and 60 enables the insert to be used with many different bucket designs.

A mop bucket of conventional design is represented by the numeral 64 and includes a conventional mop wringer 66 having a movable handle 67. The bucket has side walls 68 and 70, outwardly bowed end walls 72 and 74, and a bottom 76 which combine to form a liquid holding cavity 78 within the bucket. The walls 68, 70, 72 and 74 terminate in an upper rim 80.

The insert 10 is applied to bucket 64 by hooking the arms 54 and 55 over the rim 80 on wall 74 of the bucket. When the insert 10 is placed within the bucket 64 a substantially segregated compartment 84 is formed between the bottom 76 of the bucket and the bottom surface 16 of the platform. In addition to its stabilizing function, the foot 62 insures that the platform 12 is spaced at least a minimum distance in the order of magnitude of approximately one inch from the bottom 76. The platform covers a substantial portion of the bottom of the bucket with the width of the platform 12 between walls 38 and 44 being slightly less than the width of the bottom 76 between walls 68 and 70. The length of the platform 12 between walls 46 and 48 is preferably more than one-half the length of the bottom 76 between walls 72 and 74. Space is thus presented around the platform to provide communication between compartment 84 and the liquid above the platform 12. When the bucket 64 is filled with a cleaning liquid, the liquid in the compartment 84 is in communication with the liquid in the other regions of the bucket but is substantially segregated by the insert 10 from the mixing forces which may be imparted to the liquid by a mop or other cleaning instrument.

During cleaning operations, a mop is wetted by placement in the liquid contained in the bucket 64. The mop is then removed and placed in the wringer 66 where excess liquid is removed by pressing down on the handle 67. The mop is then applied to a surface such as a floor which is in need of cleaning. Solids on the surface are picked up by the mop and the mop may then be returned to the liquid in the bucket 64 and pressed against the top surface 14 of the platform 12 with an up and down motion to remove the solids from the mop. The solids which are thus suspended in the liquid will then settle under the influence of gravity into the compartment 84 where they are confined, and the liquid in the remainder of the cavity 78 is kept relatively free of suspended solids. A chemical such as a suitable flocculent may also be added to the liquid prior to or during the cleaning process to cause the solids to flocculate and settle at a faster rate.

Solids which settle on the upper surface 14 of the platform 12 will move under the influence of gravity to the peripheral edge 36 of the platform due to the inclined orientation of the sections 20, 22, 24, 26, 28, 30 and 32. The perforations 50 provide access for the the solids to then settle into the compartment 84 instead of remaining on the upper surface 14 where they would be subject to the mixing forces resulting from subsequent dipping of the mop into the bucket.

The solids which have settled into the compartment 84 are substantially shielded by the insert 10 from mixing forces in the liquid. The height of walls 40, 42 and 48 and the slope of the upper edges of walls 38 and 44 directs the mixing forces away from the end wall 74 and toward the end wall 72 so that the energy created is absorbed by the body of liquid in the cavity 78 outside of the compartment 84. In addition, the front wall 46 provides a lip which directs the mixing forces in an upward direction away from the solids in the compartment 84. The solids are thus effectively segregated from the mixing forces and will remain confined in the compartment 84 during normal cleaning operations. The major part of the settled solids is located beneath platform 12, and any tendency for the solids to rise and mix with the liquid is resisted by the platform in that the platform forms a barrier which prevents solids from passing above the platform and mixing with the main body of liquid in the cavity 78.

The platform 12 also allows a greater mixing force to be created in the region above the platform to aid in removal of the solids entrained in the mop strings without risk of stirring up the solids which have settled into the compartment 84. The broad top surface 14 allows the mop strings to spread out, exposing more of the strings to the liquid and thereby aiding in the removal of the entrained solids. The platform 12 and walls 38, 40, 42, 44, 46 and 48 further aid in keeping the settled solids in place by preventing the mop strings from contacting the solids which have settled into compartment 84.

When the cleaning operation is finished, the insert 10 may be easily detached from the bucket 64 and the contents of the bucket disposed of. While the insert 10 is detachable from the bucket 64 in the preferred embodiment, the insert may alternatively be integrally molded as a part of the bucket.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus defined the invention, we claim:

1. Apparatus for insertion into a container having side walls and a bottom and adapted to hold a cleaning solution, said apparatus comprising:

a platform adapted to be disposed in said container, said platform having upper and lower surfaces and a peripheral edge; means for supporting said platform in the container in spaced relationship to the bottom of the container; and a wall comprising opposed side wall portions which extend upwardly to approximately the top of said container side walls, a back wall portion which extends upwardly to approximately the same height as said side wall portions, and a front wall portion which extends upwardly a distance sufficient to hold a cleaning instrument placed in said container on the upper surface of said platform, said front wall portion having a plurality of spaced apart openings which extend downwardly at least as far as said upper surface;

at least a portion of said upper surface sloping toward said apparatus wall; and a downwardly projecting foot coupled with said platform and adapted to contact the bottom of said container to maintain said platform in closely spaced relation to said bottom.

2. The invention of claim 1, wherein said side wall and back wall portions are disposed on said platform so as to extend in close proximity to said container side walls.

3. An apparatus for use with a cleaning solution, said apparatus comprising:

a container having side walls and a bottom, and adapted to hold the cleaning solution;

a platform adapted to be disposed within the container, said platform having upper and lower surfaces;

means for supporting the platform in the container in spaced relationship to the bottom of the container; and a wall comprising opposed side wall portions which extend upwardly to approximately the top of said container side walls, a back wall portion which extends upwardly to approximately the same height as said side wall portions, and a front wall portion which extends upwardly a distance sufficient to hold a cleaning instrument placed in said container on the upper surface of said platform, said front wall portion having a plurality of spaced apart openings which extend downwardly at least as far as said upper surface;

at least a portion of said upper surface sloping toward said side and front wall portions; and a downwardly projecting foot coupled with said platform and adapted to contact the bottom of said container to maintain said platform in closely spaced relation to said bottom.

4. The invention of claim 3, wherein said supporting means comprises a hook coupled with the platform for placement over a side wall of the container.

5. The invention of claim 4, wherein said hook is an outwardly and downwardly extending continuation of the platform wall.

6. The invention of 3, wherein said side wall and back wall portions are disposed on said platform so as to extend in close proximity to said container side walls.

7. Apparatus for insertion into a container having side walls and a bottom and adapted to hold a cleaning solution, said apparatus comprising:

a platform adapted to be disposed in said container, said platform having upper and lower surfaces and a peripheral edge, said upper surface sloping in the direction of said peripheral edge;

a front wall extending upwardly from said platform a distance sufficient to hold a cleaning instrument placed in said container on the upper surface of said platform, said front wall having a plurality of openings along the bottom for the passage of liquid from said platform;

a back wall extending upwardly from said platform and disposed in facing relationship to said front wall and including a downwardly extending foot for maintaining said platform in closely spaced relationship to said bottom, said back wall extending upwardly to present an integral hook portion adapted to engage an edge of a container side wall; and opposed side walls having a plurality of openings extending upwardly from said platform and merging with both said back wall and said front wall.

8. Apparatus for insertion into a container having sidewalls and a bottom and adapted to hold a cleaning solution, said apparatus comprising:

a platform adapted to be disposed in said container, said platform having upper and lower surfaces and a peripheral edge, said upper platform surface sloping toward said peripheral edge in at least two different directions;

means for supporting said platform below the level of said cleaning solution and in closely spaced relationship to said bottom;

a front wall projecting upwardly from said platform and presenting a cut away portion for receiving a cleaning instrument; and a plurality of spaced apart openings in said front wall, said openings extending downwardly to intersect the plane of said upper platform surface.

9. The invention of claim 8, wherein said supporting means comprises a hook coupled with the platform for placement over a side wall of the container.

10. The invention of claim 9, wherein said hook is an outwardly and downwardly extending continuation of the platform wall.

11. Apparatus as set forth in claim 8, wherein said platform is characterized by an absence of any openings which would cause turbulence in the solution below said platform as a result of solution passing from one side of the platform to the other.

12. Apparatus as set forth in claim 8, wherein said container is also adapted to receive a mop wringing device, said platform being of a size to at least partially extend beneath said wringing device.

13. Apparatus as set forth in claim 8, wherein is included opposed sidewall portions which extend upwardly to approximately the top of said container sidewall, and a back wall portion which extends upwardly to approximately the same height as said sidewall portions, said front wall extending upwardly only far enough to hold a cleaning instrument placed on said upper platform surface.

* * * * *